US005439312A

United States Patent [19]

Marcato

[11] Patent Number: 5,439,312

[45] Date of Patent: Aug. 8, 1995

[54] METHOD FOR APPLYING A NIGHT-VISIBLE TRAFFIC STRIPE TO A ROAD

[75] Inventor: Forrest C. Marcato, Montgomery, Ala.

[73] Assignee: The Rainline Corporation, Montgomery, Ala.

[21] Appl. No.: 5,057

[22] Filed: Jan. 15, 1993

[51] Int. Cl.[6] ..... E01F 9/087

[52] U.S. Cl. ..... 404/12; 404/14; 404/89; 404/93

[58] Field of Search ..... 404/12, 14, 89, 93

[56] References Cited

U.S. PATENT DOCUMENTS

| | | | |
|---|---|---|---|
| 3,094,046 | 6/1963 | Zipelius | 404/12 |
| 3,477,352 | 11/1969 | Harding et al. | 404/14 |
| 3,874,806 | 4/1975 | Grist et al. | 404/93 |
| 4,248,932 | 2/1981 | Tung et al. | 428/325 |
| 4,575,278 | 3/1986 | Whitney | 404/72 |
| 4,751,140 | 6/1988 | Ishihara | 404/14 |
| 4,802,788 | 2/1989 | Smith | 404/94 |
| 4,856,931 | 8/1989 | Bollag | 404/75 |

FOREIGN PATENT DOCUMENTS

| | | |
|---|---|---|
| 1238224 | 6/1988 | Canada . |
| 0124926 | 11/1984 | European Pat. Off. . |
| 2375394 | 7/1978 | France . |
| 3029909 | 3/1982 | Germany . |
| 50-12212 | 5/1975 | Japan . |
| 6607963 | 6/1966 | Netherlands . |
| 1090178 | 11/1967 | United Kingdom . |
| 2121462 | 5/1983 | United Kingdom . |

OTHER PUBLICATIONS

"Superline Pavement Marking," Kikusui Line Co., Ltd., Nagoya, Japan (Jul. 20, 1977).

Kikusui Line Co., Ltd. "Super Line Thermoplastic Corrugation Machine" brochure page (1985).

Pave-Mark Corporation, System 1552, Wet Night Visibility brochure (Jul. 1989).

Pave-Mark Corporation, The Apollo II Series, User's Guide & Maintenance Manual (May 1989).

Pave-Mark Corporation, Thermoplastic Materials & Application Equipment brochure (1989).

Pave-Mark Corporation, Hot-Applied Thermoplastic Pavement Marking Materials and Applicating Equipment brochure (not dated).

Pave-Mark Corporation, Hercules TM Road Striping Machine brochure (not dated).

Pave-Mark Corporation, MarkerGrip data sheet (not dated).

Pave-Mark Corporation, PM Eraser, Pavement Marking Remover brochure (not dated).

Pave-Mark Corporation, PM-74 Primer/Sealer System data sheet (not dated).

Pave-Mark Corporation, The Titan II Series data sheet (not dated).

Pave-Mark Corporation, Total Commitment to Your Success data sheet (not dated).

Moderne Markiertechnik, Roadliner (in German)(not dated).

Joschu Josef Schnupp KG, Ein Unternehmen mit Linie brochure (in German)(not dated).

R. S. Clare & Co., Ltd., Thermoplastic Road Marking Material (Class A BS 3262:Part 2) brochure (Apr. 1990).

R. S. Clare & Co., Ltd., Aquaflex TM brochure (not dated).

Roadcare Group Limited, Ambassadors for Safety brochure (not dated).

Superfos Dammann-Luxol a/s, Spotfles brochure (in Spanish)(1987).

Unimark Ltd., Road Marking Equipment brochure (not dated).

*Primary Examiner*—Ramon S. Britts

*Assistant Examiner*—Pamela A. O'Connor

*Attorney, Agent, or Firm*—Banner, Birch, McKie & Beckett

[57] ABSTRACT

A method and apparatus for applying a traffic stripe having improved reflectivity includes a vehicle having an apparatus for applying the traffic stripe, an applying assembly for dispersing a reflective material over the traffic stripe, another applying apparatus for applying a releasing agent, and a deformation apparatus disposed rearward thereof for forming interval grooves in the traffic stripe. The application of the releasing agent directly onto the traffic stripe or onto the deformation apparatus prevents the freshly applied traffic stripe from lifting off the road surface and adhering to the deformation apparatus.

15 Claims, 8 Drawing Sheets

METHOD FOR APPLYING A NIGHT-VISIBLE TRAFFIC STRIPE TO A ROAD

TECHNICAL FIELD

The present invention relates to a method and apparatus for applying a traffic stripe to a road surface and, in particular, a thermoplastic traffic stripe having a plurality of spaced grooves to provide improved night visibility and water drainage.

BACKGROUND OF THE INVENTION

Driving a motor vehicle during dry, daylight hours is a relatively simple task requiring one to merely obey the traffic signals and keep the vehicle within the proper traffic lane as defined by the markings on the road. This relatively simple task becomes a particularly exasperating and often treacherous assignment, however, if darkness and wet weather conditions prevail. Under this scenario, the usual night driving handicap of reduced visibility is augmented by the wet weather conditions, thus making reflective road markings virtually imperceptible.

Road markings are generally made by using either hot or cold traffic stripe paint, cold tape, or more durable materials such as epoxy or thermoplastic. Road markings generally come in two forms. There are long line stripes and transverse stripes. Long line stripes are typically lines dividing lanes of a road or a path. Normally one applies one interrupted white line or two solid yellow lines. An interrupted line is a series of predetermined length traffic stripes separated by a series of predetermined length gaps. These interrupted lines and the solid lines are normally four inches wide. When two lines are applied, they are normally also separated by four inches. These dimensions do change, however, according to different county, state and city regulations.

In certain long line applications, one may also have a solid four inch line and an adjacent interrupted four inch line. These lines are generally separated by a four inch spacing. They are normally used in situations were a plurality of center turn lanes (i.e., left hand turn lanes in the United States) are used, for example, a three lane road.

Transverse lines are normally shorter markings or legends. Transverse lines are normally considered to be stop bars, crosswalks, railroad crossing markings, words such as "ONLY", arrows, symbols and other markings and legends of that nature. Since cars often come to stops on transverse markings, transverse lines are sometimes directly subject to the power applied to back wheels during acceleration of a motor vehicle. Thus, transverse lines generally undergo more wear than long line stripes. Consequently, transverse lines are normally thicker than long line stripes.

Generally when thermoplastic is used, stripes are usually applied in thicknesses of sixty to a hundred and twenty-five thousandths of an inch, and preferably, they are usually applied at ninety to one hundred and twenty-five thousandths of an inch. Also, it is preferable, but not necessary, to add reflective material on top of the traffic stripe in order to give the traffic stripe increased reflectivity at night. The reflective material primarily consists of glass beads which are applied on top of the traffic stripe after it is applied to the road surface.

Water does not drain from conventional road markings during wet weather conditions, however, and when it rains a thin film of water will form on top of the traffic stripe and thereby significantly reduce the retroreflectivity of the glass beads used therein. If a thick film of water forms on top of the traffic stripe, such as encountered in a heavy storm, the water will totally obscure the markings from view and thus make them totally ineffective.

As a result of the deterioration in traffic guidance which occurs during dark and wet driving conditions, the incidence of traffic accidents increases and the usual smooth flow of traffic is impeded. Attempts have been made to eliminate these dangers by providing individual raised reflectors on the road surface, by using large reflective elements in the road markings which protrude above the water film, and by forming profiled road markings which have thickened transverse portions projecting above the water film.

One of the most widely used marking systems in the United States is an individual raised reflector, such as that available under the tradename Stimsonite® 948 or that shown in U.S. Pat. No. 3,332,327. The reflector generally comprises an approximately four and one-half inch by two and one-half inch marker which is raised a one-half inch from the road and has sloped side surfaces. A reflective panel is disposed on each sloped side of the marker and the entire top surface is then covered with a plastic or glass coating. As an example, the individual markers are placed every forty feet or so, such that one hundred thirty two markers are used for each mile of road marking. The markers thus provide a raised reflectorized surface every forty feet or so to assist the motorist when driving during dark and wet weather conditions. The markers are put down by using an epoxy glue or an adhesive, however, them is still a problem with maintaining the markers on the road surface. For instance, on a hot summer day when the asphalt is especially soft, a heavy truck running over the marker will tend to push it into the asphalt below the surface of the road. Heavy trucks also tend to knock the markers up off of the road, thus leaving a hole where the marker used to be. Thus, in both instances, the effectiveness of the reflectorized marker is destroyed. The cost for such individual markers and their installation is also a significant drawback since utilization of the markers on top of road striping can increase the cost of road markings by four hundred dollars per mile, or more, dependent upon the spacing of the markers.

As an alternative to reflectorized markers, large glass beads have also been utilized to provide a profiled road marking have a pebble-like finish. In this system, produced by R.S. Clare & Co. Limited under the tradename Aquaflex TM, large one to four millimeter glass beads and small crushed stones are spread on top of a binder coat layer and then overcoated with paint. Smaller conventional reflective beads are then dispersed over the painted line. The portions of the large glass beads protruding above a water film on the road surface provide a reflective surface because they are covered with small reflective beads and the large glass beads themselves will also provide increased reflectivity to the road marking. Using this type of large glass beads substantially increases costs, however, and since the larger beads are not universally accepted for road marking, approval on a state by state basis is required. Further, because of their size, the large glass beads do not adhere well to the road marking and have a tendency to be dislodged by traffic.

A further marking system which is utilized primarily in Europe is generally described in U.K. Patent Application 2,121,462. This marking system uses a relatively thick striping material and a shaped die through which the striping material is extruded. The striping is applied in a line approximately one and one-half to three millimeters thick and every ten to fifty centimeters the die is raised to increase the outflow of the striping material and thereby form a wavy transverse ridge approximately five to ten millimeters thick. The striping material generally includes glass beads that are mixed therewith and additional glass beads are preferably sprinkled on top of the applied marking before it is completely hardened. Thus, the spaced ridges form a profiled marking having raised retroreflective surfaces at specified intervals which will project above the surface of a water film and thereby provide visible markings during dark and wet weather conditions. The glass beads covering the raised ridges, however, soon wear away due to the constant travel of traffic and, eventually, even the raised ridges themselves will wear down. Within a relatively short period of time, therefore, the increased visibility provided by the profiled marking is destroyed. In addition, the thickness of the marking prevents the water from properly draining from the road surface when the marking is applied as an edge line. This creates a pocket of standing water at the edge of the road surface which may cause vehicles to skid, thus leading to increased accidents.

A strong need therefore exists for a road marking having increased reflective properties such that it is visible at night during wet weather conditions, which is durable and economical to apply, and which allows for water drainage from the road surface.

SUMMARY OF THE INVENTION

The preferred apparatus of the present invention for applying a traffic stripe to a road surface includes a vehicle having a pair of front wheels and a pair of rear wheels, an applicator for applying a traffic stripe to a road surface, at least one applicator for applying a reflective material over said traffic stripe on the road surface, a rotatable wheel having a plurality of spaced projections around the periphery thereof, and an applicator for applying a releasing agent which prevents adhesion of the applied traffic stripe to the rotatable wheel when the wheel passes thereover. The rotatable wheel is configured such that the spaced projections form corresponding spaced grooves in the applied traffic stripe. The releasing agent is preferably applied directly onto the applied traffic stripe, but may instead be applied onto the rotatable wheel. The releasing agent utilized in the preferred embodiment of the invention is water, however, the reflective material alone may also be used in an appropriate layer thickness to prevent the traffic stripe from adhering to the rotatable wheel.

The preferred method of the present invention for applying a night-visible traffic stripe to a road surface includes applying a thick marking traffic stripe to a road surface, applying a reflective material to the traffic stripe, applying a releasing agent to prevent adhesion between the applied traffic stripe and a deformation means passing over it, and deforming the traffic stripe with the deformation means to form spaced grooves in the traffic stripe. The preferred method of the present invention applies a thermoplastic stripe to the road surface and passes a rotatable wheel having a plurality of projections around the periphery thereof over the thermoplastic stripe such that the stripe is deformed and spaced grooves are formed therein. A releasing agent, such as water, is preferably sprayed onto the thermoplastic stripe prior to the deforming step to prevent the still warm thermoplastic stripe from adhering to the wheel. In other preferred embodiments of the invention, the reflective material may also be used as the releasing agent by applying an excess amount of the reflective material or the releasing agent may be applied directly onto the rotatable wheel instead of the stripe.

Thus, the preferred apparatus and method of the present invention form spaced grooves in a freshly applied reflective thermoplastic stripe by using a rotatable deformation means, such as a wheel. The grooves in the traffic stripe provide additional reflective surfaces for the headlights of an oncoming automobile within the driver's line of vision and thereby increase the visibility of the line without significantly increasing the cost. The grooves are resistant to wear from the constant flow of traffic because the much larger surface of the stripe itself between the grooves is the load beating surface. The disadvantage of using relatively narrow raised ridges, which tend to wear out, is thus overcome. In addition, the grooved traffic stripe allows the rain to drain from the road surface and thereby prevents the dangerous accumulation of water at the edge of the road. Further, conventional reflective glass beads can be used in order to avoid the dislodging problem experienced with the large sized beads. The use of conventional beads also eliminates the tedious state-by-state approval process required for large or exotic beads.

BRIEF DESCRIPTION OF THE DRAWINGS

The above description and other objects, advantages, and features of the present invention will be more fully understood and appreciated by reference to the specification and accompanying drawings, wherein.

DETAILED DISCUSSION OF THE PREFERRED EMBODIMENTS

Figure 1:
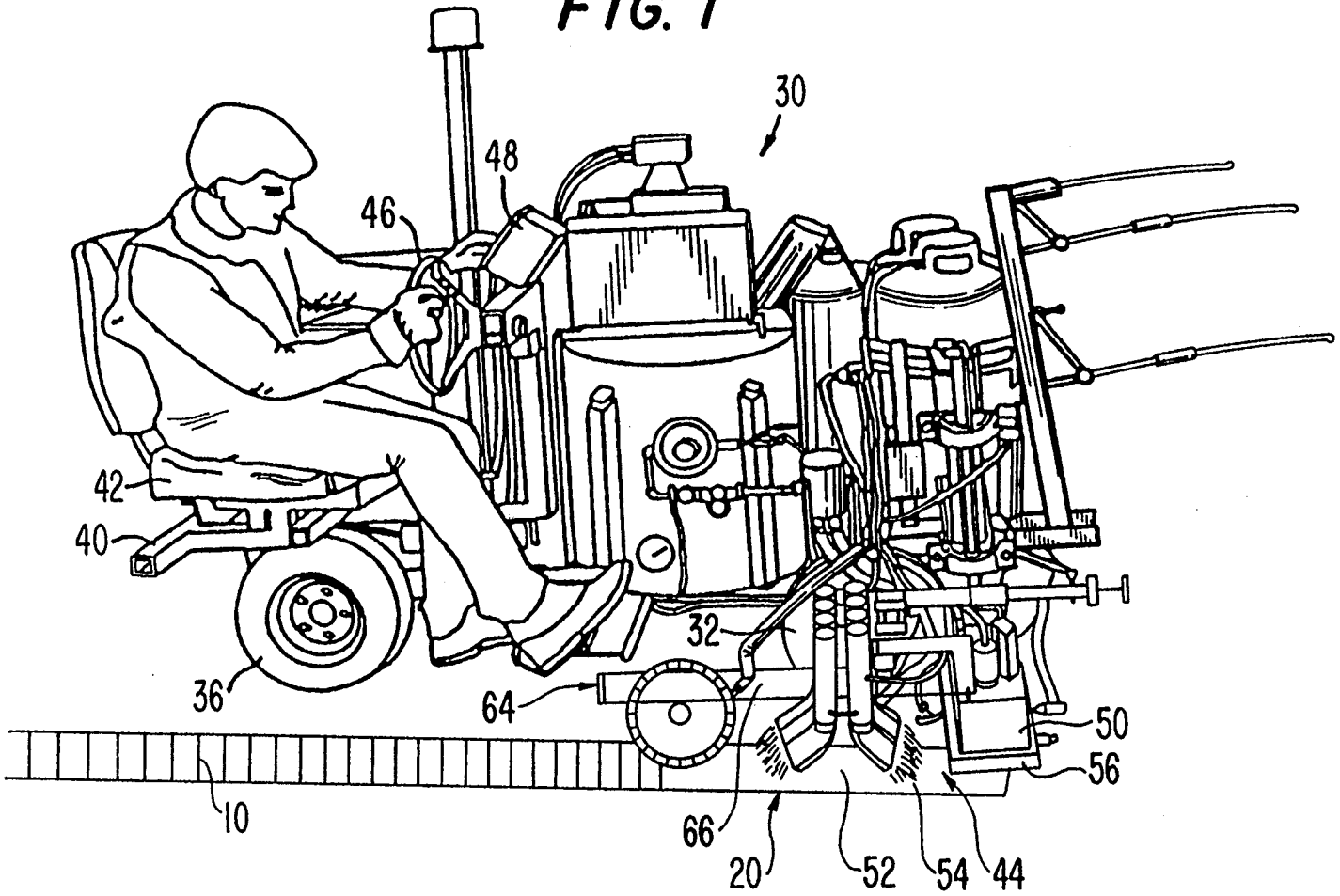
FIG. 1 is a right-side view of a vehicle including a preferred embodiment of an apparatus for applying a night-visible traffic stripe to a road in accordance with the present invention.
Figure 9:
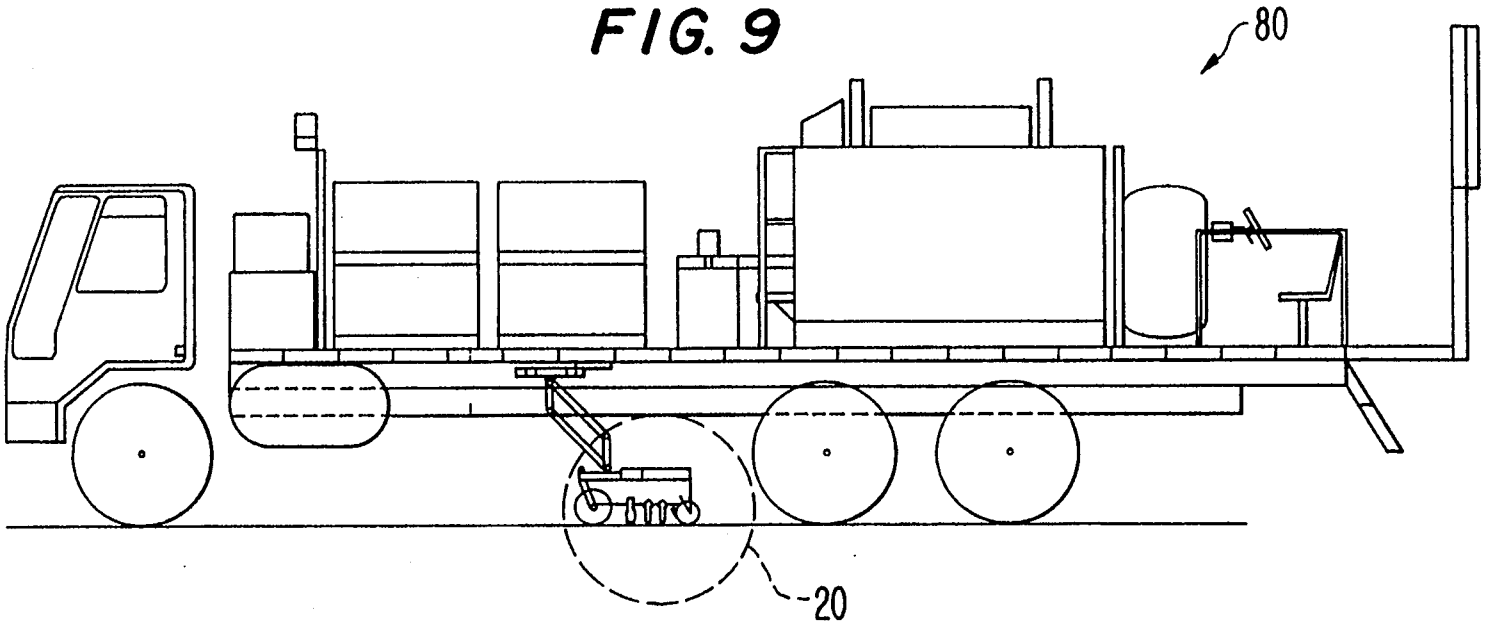
FIG. 9 is a left-side schematic of a preferred vehicle including the apparatus of FIG. 4 for applying a night-visible traffic stripe to a road in accordance with the present invention.

Referring to FIG. 1, a preferred apparatus 20 for applying a traffic stripe 10 to a road surface is shown attached to a vehicle 30. Vehicle 30 includes a pair of front wheels 32 and 34 and a pair of rear wheels 36 and 38 and is disclosed in further detail in U.S. Pat. No. 5,114,268 issued May 19, 1992 to the same inventor as the present invention, the disclosure of which is hereby incorporated by reference. Referring to FIG. 9, a further embodiment of apparatus 20 is shown attached to a preferred vehicle 80, such as that manufactured by Mac Stripers, Inc. under Model No. TM 10,000. Vehicle 30 or 80 progresses at 1–5 mph, preferably 2 mph, when applying traffic stripe 10 in accordance with the present invention. Apparatus 20 may be attached to any vehicle for applying a traffic stripe depending upon the desired marking and should, therefore, not be limited to the vehicles 30 or 80 shown and described herein. Vehicle 80 is a relatively large truck in which large quantities of striping materials can be carried. It would thus be advantageous to practice the present invention with vehicle 80 where the application of traffic stripes over a large distance is desired or necessary. However, for the purpose of discussing the application of traffic stripes according to the present invention specific reference will be made to vehicle 30.

Included on vehicle 30 of FIG. 1 is a frame extension 40 with a seat 42 for supporting a driver. Driver supporting seat 42 is disposed between the front and rear wheels and on the same side of the vehicle as traffic stripe applying system 44. Vehicle 30 also has a system for steering the front wheels including a steering wheel 46 adjacent supporting seat 42 of FIG. 1 for manually controlling the direction of steering.

Disposed outward of and adjacent to front wheels 32 and 34 in FIG. 1 is a system 44 for applying a traffic stripe to a road. With this system, traffic stripe widths and lengths can be easily adjusted from the driver's seat through the use of electrical switches mounted on a control box 48 shown in FIG. 1.

Thermoplastic is a durable line marking material which should last up to ten times as long as traffic paint on the same location. Thus, although system 44 could also be used as shown for applying traffic paint, cold tape, epoxy or other materials to form a traffic stripe, it is preferable to use thermoplastic striping assembly 50 in the present invention.

The resin thermoplastic is heated in accordance with well-known principles. The thermoplastic is normally heated in a tank to between 380° F. and 450° F., but preferably approximately 400° F. or so. This heated thermoplastic is then delivered through gravity or under pressure from a pump to striping assembly 50. Thermoplastic is normally applied in generally straight lined stripes at 400° F. so that it bonds to the road. Although thermoplastic bonds better on an asphalt surface, it can be effectively used on concrete surfaces as well.

There are at least three different methods for applying thermoplastic to the road. One uses an extrusion or screed assembly, the other uses a ribbon gun or airless ribbon gun assembly, and the third uses an air atomized spray assembly. The extrusion assembly lays stripes of thermoplastic on the road and then cuts the stripe with a blade at desired line ending points. Since extrusion systems require a cutting blade dose to the surface of the road, they have certain drawbacks. For example, when the system hits rocks in the road, the blade could be damaged or the blade could be disrupted. In either case, the precision and the depth of the line is affected. Also, when different line widths are desired, such as going from four inches to eight inches, one must normally remove a bottom with one size outlet from the extrusion assembly and take approximately ten minutes to safely install a new extrusion bottom with another size outlet.

An air atomized spray assembly sprays the thermoplastic directly onto the road surface. The viscosity of the thermoplastic used in this operation is very thin, however, and as a result the thermoplastic is not ideally suited for use with apparatus 20 of the present invention because it is generally too thin to be profilable.

In contrast, a ribbon gun or airless ribbon gun assembly applies the heated thermoplastic through outlets directly onto the road surface to which it then bonds. Thus, there is no blade to be damaged by rocks in the road and the thermoplastic does not need to be extremely thin in order to be applied through the ribbon gun outlets. In addition, the ribbon gun assembly allows for adjusting the line width from, for example, four to eight to twelve inches without having to manually replace bottom outlets. Thus, although an extrusion assembly or air atomized spray assembly could be used, a ribbon gun or airless ribbon gun assembly is the preferred thermoplastic striping assembly 50 of the present invention.

Figure 2:
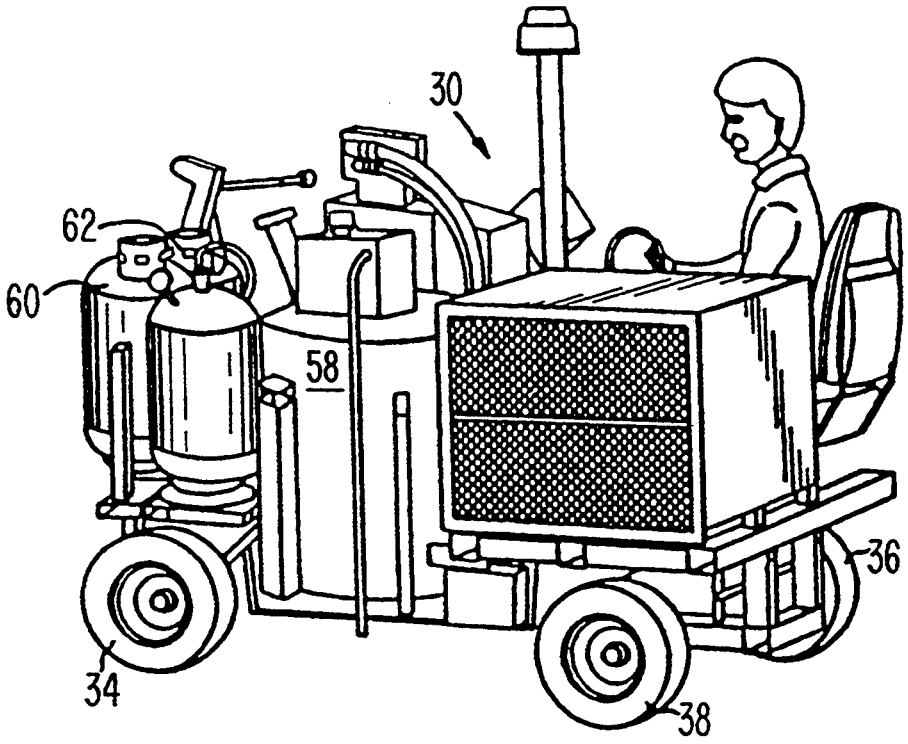
FIG. 2 is a left-side perspective view of the apparatus of FIG. 1.

Thermoplastic striping assembly 50 includes, as shown, a housing 56 preferably having four sides and an outlet through which the thermoplastic is applied to the road. Referring also to FIG. 2, vehicle 30 holds a tank 58 of thermoplastic. The thermoplastic material holding tank advantageously has a capacity of four hundred pounds in the embodiment shown. Other vehicles, such as vehicle 80, having greater or lesser capacity could, of course, also be utilized with the thermoplastic striping assembly 50 of the present invention. Under the holding tank 58 is a burner for heating the thermoplastic from between 350° F. and 450° F. Preferably, two thirty pound propane tanks 60 and 62 are used for the heating system. Sometimes the thermoplastic is heated and immediately conveyed to the road and other times it is heated and stored briefly before conveyance to the stripe application system. Any thermoplastic suitable for extrusion or ribbon gun application can be used with apparatus 50 of the present invention. In a preferred embodiment a thermoplastic is used meeting the specifications of AASHTO M249-79 (1986) extrusion formulation and having a viscosity of 12,000–14,000 Centipoise when in a liquid state at the time of application. An example of such a thermoplastic is available under the tradename Cata-therm TM manufactured by Cataphote, Inc. Other available thermoplastics having a viscosity of at least 4,000 Centipoise in a liquid state at the time of application could also be used.

Vehicle 30 uses a heavy-duty hydrostatic drive system. This system uses an infinitely variable speed drive for forward and reverse with a single foot control peddle. It also serves as the primary braking system. In addition, included is an optional emergency air-operated friction brake located on the rear wheels. A twenty horse power engine is used for propelling the vehicle up to six miles per hour in a forward or reverse direction. The empty weight of this vehicle is approximately eight hundred pounds.

Figure 3:
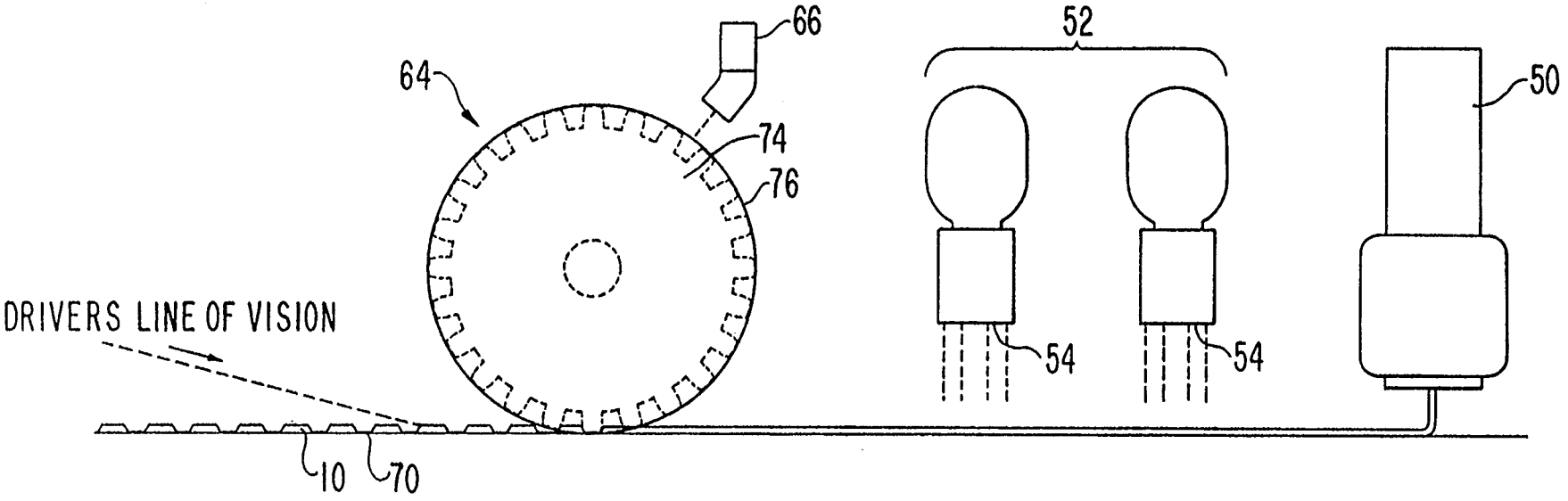
FIG. 3 is an exploded schematic of the apparatus for applying a night-visible traffic stripe shown in FIG. 1.

Referring to FIGS. 1 and 3, traffic stripe applying system 44 is shown applying a continuous traffic stripe to a road. In this instance, the traffic stripe applying system 44 sprays the thermoplastic stripe 10 with a ribbon gun. Also shown is an assembly 52, disposed rearward of and in alignment with ribbon gun or thermoplastic striping assembly 50, for applying or spraying reflective material over the applied thermoplastic stripe 10. Preferably, the reflective material is held in a tank on the vehicle with a capacity of approximately one hundred twenty-five pounds and is fed, when desired, under a pressurized system. Reflective material applying assembly 52 includes at least one jet outlet 54 through which a reflective material is dispersed from a holding tank. Reflective material applying assembly could also include a drop-on bead gun from which the reflective material is fed under gravity onto the thermoplastic stripe. In the preferred embodiment of FIGS. 1–3, two outlets are in fact utilized. The reflective material preferably comprises a plurality of fine glass beads. Glass beads meeting the specification of AASHTO M247-Type 1 and having a sieve size of approximately −20 to +80 can be used. The present invention should not be limited to the use or size thereof, however, since assembly 52 could be adapted for use with any size particulate reflective material.

To apply thermoplastic stripe 10 as either a continuous reflective stripe or an interrupted stripe, from ribbon gun or thermoplastic striping assembly 50 requires a certain arrangement of the assembly outlets as well as controls for controlling the opening and closing of a portion of the assembly so that the stripes and gaps of pre-determined length can be repeatedly applied. Such an electronic control means to direct the appropriate mechanical elements in assembly 50 is described in U.S. Pat. No. 3,477,352 to Harding, et al., which is hereby incorporated by reference. The electronic control means described in U.S. Pat. No. 3,477,352 to Harding, et al. can also control reflective material applying assembly 52 such that the reflective material is primarily applied or sprayed only over the thermoplastic stripe 10, as shown in FIGS. 1 and 3.

Figure 7:
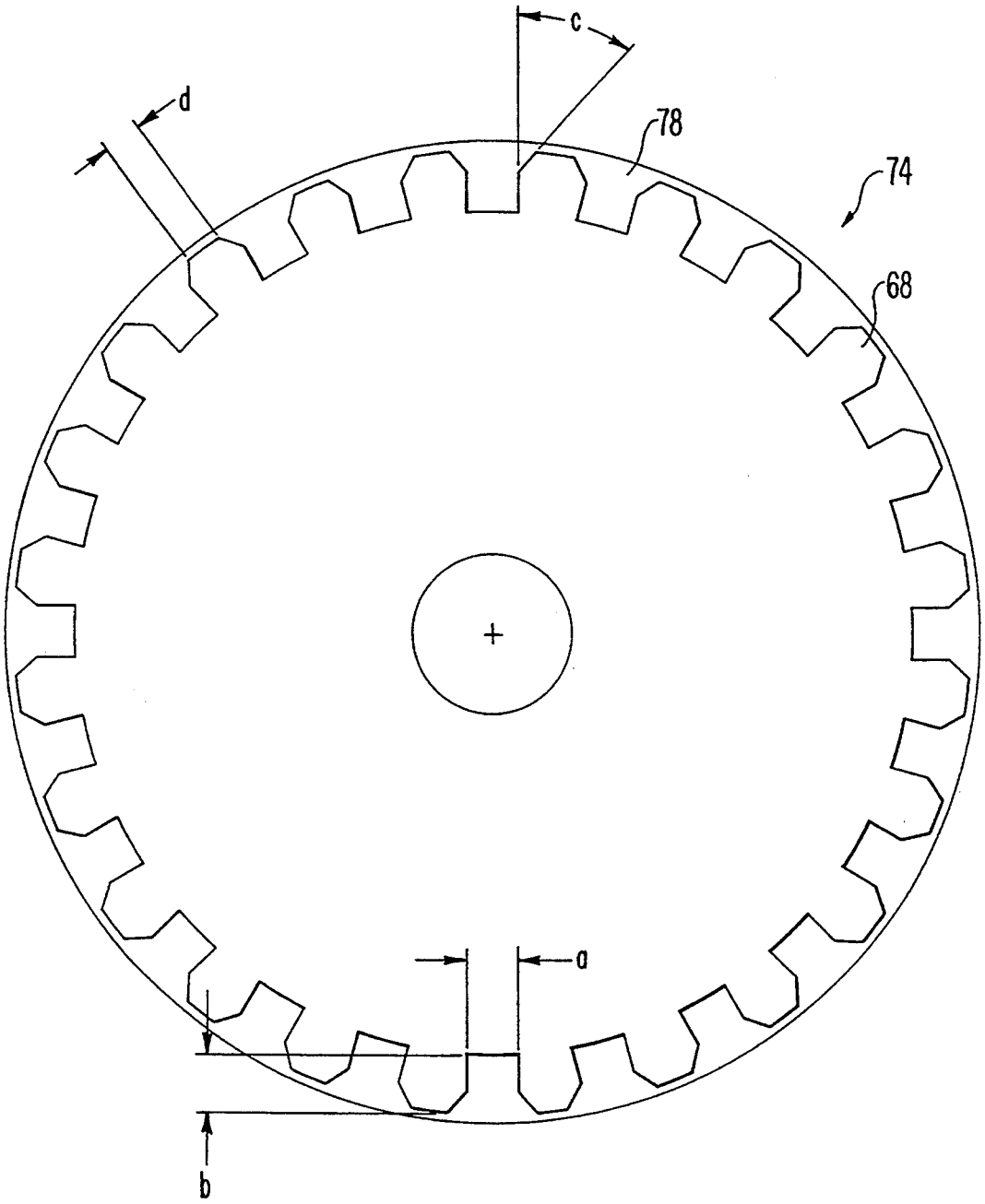
FIG. 7 is a side elevational view of the wheel shown in FIG. 1.

In addition to thermoplastic striping assembly 50 and reflective material applying assembly 52, the present invention further provides a rotatable wheel assembly 64 and a releasing agent assembly 66 disposed rearward of thermoplastic striping assembly 50 and reflective material applying assembly 52. As shown in FIG. 7, wheel assembly 64 includes a wheel 74 having plurality of spaced projections 68 which thereby form corresponding grooves 70 having, a depth of at least 0.04 inch and, preferably, a minimum depth of 0.0625 inch in thermoplastic stripe 10 when wheel 74 passes thereover. In the embodiment shown in FIG. 1, releasing agent assembly 66 is disposed forward of wheel 74 such that a releasing agent is applied to the periphery of wheel 74 prior to its contact with thermoplastic stripe 10. Since the thermoplastic must be applied at a temperature of 400° F. or so in order to bond to the road, the thermoplastic will also bond to wheel 74 or any other structure passing thereover immediately after its application. Thus, a releasing agent of some kind must be used to prevent the adhesion of the freshly applied thermoplastic to wheel assembly 64.

Referring to FIG. 7, wheel 74 has a plurality of projections 68 spaced apart by a distance "a" preferably between one-quarter and one-half inch and having a depth "b" of approximately one-half inch. Projections 68 are disposed to create grooves spaced between 0.25 and 2.0 inches apart and having a minimum depth of 0.04 inch and preferably 0.0625 inch, in order to produce grooves in the thermoplastic stripe which would increase the reflectivity of the line. The preferred diameter of wheel 74 is approximately twelve inches in order to accommodate the desired speed of vehicle 30, but smaller diameters in the range of seven inches may also be used. Projections 68 are preferably formed with angled upper side surfaces in order to provide additional reflection surfaces within the driver's line of vision. When these surfaces have an angle "c" between thirty degrees and forty-five degrees they are effective for producing a thermoplastic line which appears to be continually reflective, despite the fact that the reflective surfaces are spaced apart. When a thirty degree angle is utilized, it is found that the thermoplastic material releases more easily from wheel 74. If a ninety degree angle is formed on wheel 74, a thermoplastic line having increased reflectivity is still obtained due to the viscosity of the thermoplastic. That is, the thermoplastic will not be thick enough to form a perfect ninety degree angle, and thus an angled surface will naturally form when wheel 74 releases the thermoplastic from the recess thereon.

Projections 68 also have a flat upper surface with a length "d" of approximately one-quarter inch which forms the bottom of groove 70. In the preferred embodiment, disposed on each side of wheel 74 are end disks or rims 76 and 78 having a diameter approximately one-sixteenth inch greater than that of wheel 74. Thus, wheel 74 can be utilized alone, or end disks 76 and 78 can be used in order to hold wheel 74 above the road surface and thereby prevent the grooves in the thermoplastic stripe from extending down to the bare road surface.

Figure 8A:
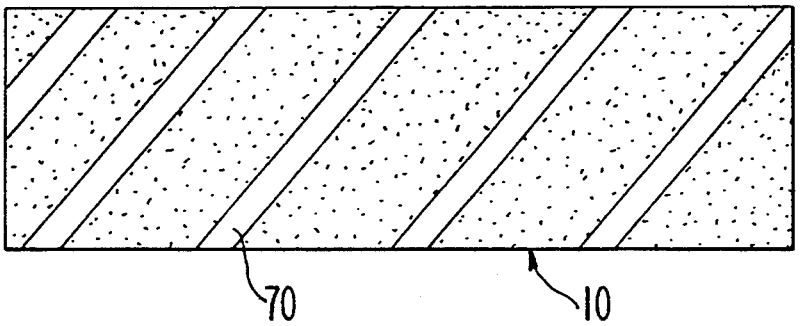
FIG. 8(*a*)–8(*c*) is a schematic of various traffic stripes according to further embodiments of the present invention.
Figure 8B:
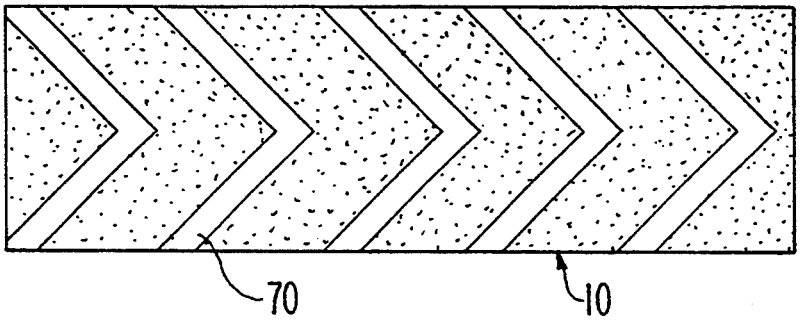
Figure 8C:
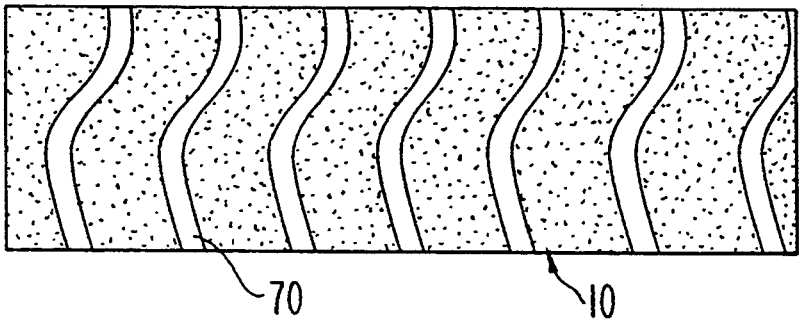

The projections 68 of wheel assembly 64 form spaced transverse grooves 70 in the applied thermoplastic stripe 10 in the illustrated example that are perpendicular to the longitudinal dimension of the traffic stripe. However, it should be understood that any configuration, spacing, or angle of groove would also be satisfactory as long as the grooves provide a reflective surface which can be viewed from a vehicle. In particular, to make a traffic stripe which is durable against the frequent use of snow plows, it is within the scope of the present invention to form diagonal grooves across thermoplastic stripe 10, as shown in FIG. 8(*a*). The use of diagonal grooves maintains the snow plow blade on the uppermost surface of the marking and thus prevents the blade from ever getting into the grooves below the upper surface of thermoplastic and thus damaging the thermoplastic road stripe. Examples of suitable groove orientations are shown in FIGS. 8(*a*) to 8(*c*).

The preferred releasing agent used in releasing agent assembly 66 is a liquid, such as water. It should be understood, however, that other releasing agents could be utilized in the present invention, including, but not limited to, the reflective material which is utilized over the traffic stripe. Referring to FIG. 3, apparatus 20 of the present invention is schematically illustrated. Thermoplastic striping assembly 50 applies a continuous or interrupted reflective stripe 10 to the road surface and reflective material applying assembly 52 then disperses a quantity of small glass beads or the like over the stripe 10. Thus, a conventional thermoplastic reflective stripe is obtained. Apparatus 20 further provides releasing agent assembly 66 which applies or sprays water, or another liquid, onto the periphery of wheel assembly 64 before it passes over the still warm thermoplastic stripe 10. The presence of the releasing agent on the wheel assembly prevents the still warm traffic stripe from lifting off the road surface and clogging the corresponding depression on the wheel assembly.

Figure 6:
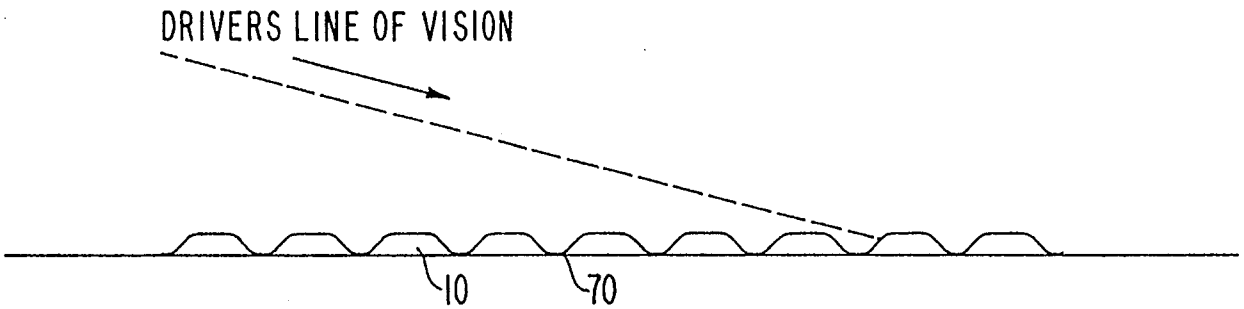
FIG. 6 is an elevational view of the traffic stripe of the present invention.

As a result of this operation, a thermoplastic stripe is obtained which has spaced grooves 70 therein, as shown in FIG. 6. The presence of the grooves 70 improves the reflectivity of the line 10 in two ways. First, the presence of grooves within a thick thermoplastic line allows the water to drain from the surface of the road when the thermoplastic line is utilized as an edge striping. Thus, standing pockets of water are prevented and the hazards of skidding are therefore reduced. In a preferred embodiment of the invention, thermoplastic stripe 10 has a thickness between approximately 0.125 and 0.250 inch and grooves 70 are formed to a depth such that a base of thermoplastic material having a thickness "e" in the range of approximately 0.01 to 0.04 inch, preferably 0.02 inch, remains on the road surface in the area of the groove. It is within the scope of the present invention, however, for thermoplastic stripe 10 to be formed with a thickness between 0.06 and 0.375 inch, or more. The base should have a thickness in the above-mentioned range to assure that stripe 10 has an adequate bond area to the road surface, while at the same time allowing water drainage off of the driving portion of the road surface. The preferred technique for assuring the proper thickness "e" of the base of the grooves is by using end disks 76 and 78 on wheel 74. In the disclosed embodiment, wherein disks 76 and 78 have a diameter one-sixteenth inch greater than the diameter of wheel 74 (the outer diameter defined by projections 68) a base thickness of at least 0.03125 inch is assured. Another technique would be to properly adjust and balance the viscosity of the thermoplastic with the weight of wheel 74 and the timing of the formation of the grooves.

Grooves 70 are shown extending transversely across thermoplastic stripe 10 in the preferred embodiment, however, as previously described, any orientation or geometry could be utilized and the spacing between adjacent grooves can also be varied between approximately 0.25 and 2.0 inches, or 4.0 inches, or more. In addition, the angled surfaces forming the sides of grooves 70 in the thermoplastic stripe 10 provide additional reflective surfaces for the headlights of oncoming cars. The driver's line of vision also perceives the reflection from these angled surfaces and the visibility of the stripe is thus increased. Accordingly, thermoplastic stripe 10 of the present invention provides a reflective traffic marking having improved visibility in wet and dark weather conditions.

Figure 4:
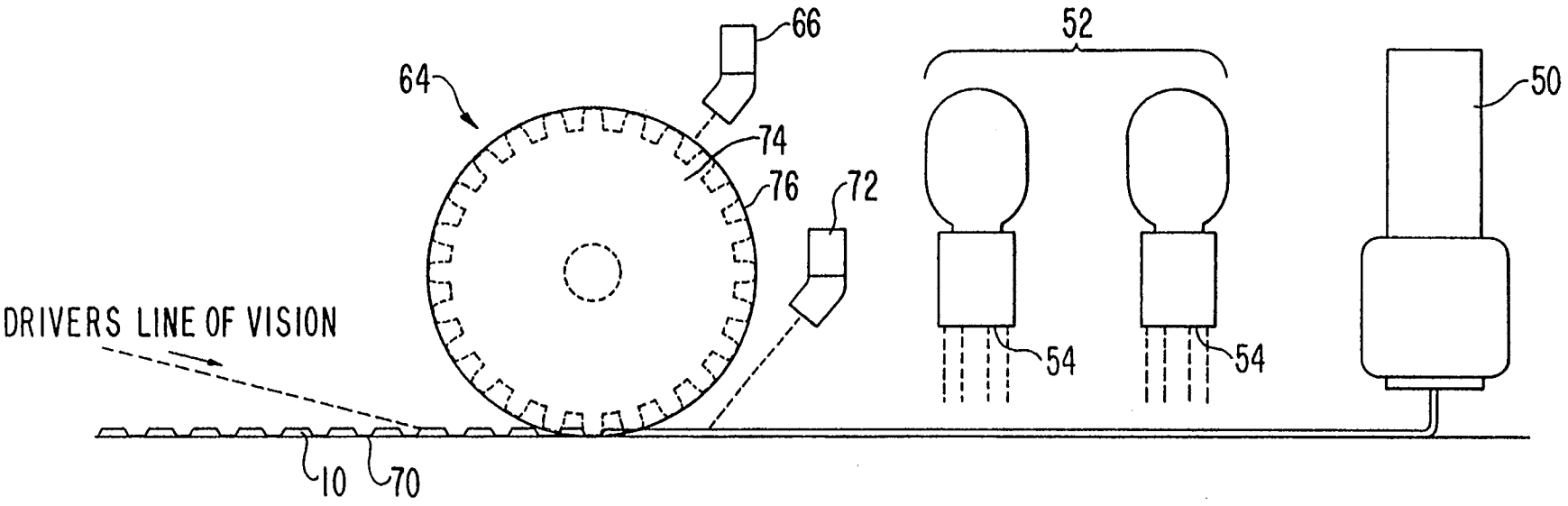
FIG. 4 is an exploded schematic of an apparatus for applying a night-visible traffic stripe in accordance with another embodiment of the present invention.

Referring to FIG. 4, a further embodiment of the present invention is illustrated. In this embodiment a lower releasing agent assembly 72 is utilized in conjunction with releasing agent assembly 66. That is, in addition to a releasing agent being sprayed directly onto wheel assembly 64, a releasing agent is also dispersed directly onto the traffic stripe 10 prior to wheel 74 passing thereover. The use of lower releasing agent assembly 72 is not mandatory, however, it further assists in the prevention of adhesion between the freshly applied and still warm thermoplastic line and wheel assembly 64.

Figure 5:
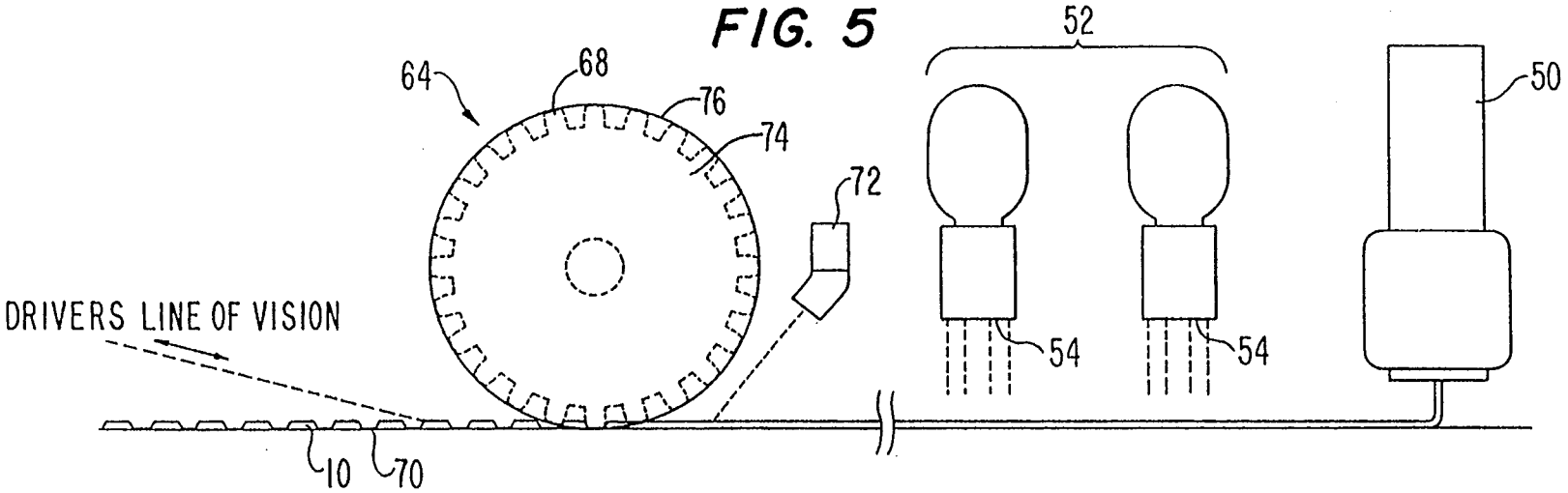
FIG. 5 is an exploded schematic of an apparatus for applying a night-visible traffic stripe in accordance with yet another embodiment of the present invention.

FIG. 5 illustrates yet another preferred embodiment of the present invention and a modification thereof as explained below. In this instance, only lower releasing agent assembly 72 is used. That is, a releasing agent is dispersed directly onto thermoplastic stripe 10 prior to wheel assembly 64 passing thereover. The use of a releasing agent applied only to the thermoplastic stripe is sufficient to prevent the adhesion of the hot thermoplastic to wheel 74, and in fact is preferable to the application of the releasing agent just to the wheel 74 as discussed above with respect to FIGS. 1–3. As with the previous embodiments, the releasing agent in this instance can be either a liquid or a further coating of the reflective material, such as, small glass beads or the like. When the particulate reflective material is used as the releasing agent, an excess amount of the reflective material is used so that a sufficient amount of the particulate material loosely covers the stripe to prevent the thermoplastic material from sticking to wheel 74. For example, when the above-mentioned beads meeting the specifications of AASHTO M247-Type 1 are used, 0.14 pounds/foot is applied to a four inch wide stripe and is sufficient to form a reflective layer bonded to the material to work as a releasing agent. The exact amount that would be required for a given thermoplastic and given application conditions can be readily determined through routine testing, but is generally in the range of twice the usual amount used for reflection purposes alone.

The method and apparatus for producing a grooved traffic marking has been shown and described above according to the preferred embodiments thereof. Other modifications to the preferred embodiments could include the use of the wheel assembly as a separate detached operation from that of applying the thermoplastic line such as by using a second vehicle, as represented in FIG. 5. In such a modification, the releasing agent assembly could be on either the first or the second vehicle. Also, while a separate releasing agent application assembly is shown, when the releasing agent used is the particulate reflective material, the excess particulate material can be applied by the reflective material application assembly. It should be obvious to one skilled in the art that various other modifications and alterations can be made without departing from the scope of the present invention, which is to be limited only by claims appended hereto.

What is claimed is:

1. A method for applying a night-visible traffic stripe to a road surface, said method comprising the steps of:

applying a material capable of adhesion and forming a traffic stripe to a road surface;

applying a first particulate reflective material to the traffic stripe with a first reflective material applicator and incorporating the first reflective material into the traffic stripe;

applying means for preventing adhesion between the traffic stripe material and a deformation means such that the deformation means remains substantially free of traffic stripe material during a deformation step; and deforming the traffic stripe material with the deformation means to form spaced grooves in the traffic stripe material;

wherein said step of applying means for preventing adhesion includes applying a second particulate reflective material to the traffic stripe with a second reflective material applicator prior to said deforming step to form a barrier of the second reflective material on an upper surface of the traffic stripe that prevents adhesion between the traffic stripe material and the deformation means.

2. The method of claim 1 wherein said applying step comprises forming a thermoplastic line by extruding the thermoplastic material from an extrusion die assembly.

3. The method of claim 1 wherein said applying step comprises forming a thermoplastic line by extruding the thermoplastic material from a ribbon gun.

4. The method of claim 1 wherein said applying step comprises forming a thermoplastic line by extruding the thermoplastic material from an air atomized spray gun assembly.

5. The method of claim 1 wherein said step of deforming the traffic stripe material includes serially pressing projections into the traffic stripe material to form the spaced grooves.

6. The method of claim 5 wherein said step of deforming the traffic stripe material further includes preventing the projections from contacting the ground to form a base layer of the traffic stripe material in the bottom of the grooves between the raised traffic material on either side of each respective groove.

7. The method of claim 1 wherein the deformation means comprises a rotatable wheel having projections with spaced grooves around the periphery thereof and said deforming step comprises passing the rotatable wheel over the traffic stripe material such that spaced grooves are formed in the traffic stripe material by pressing the projections into the traffic stripe material.

8. The method of claim 7 wherein said step of deforming the traffic stripe material includes supporting the projections of the rotatable wheel above the road surface while passing the rotatable wheel over the traffic stripe material to assure that a base layer of traffic stripe material remains in the bottom of the formed grooves.

9. The method of claim 7 wherein said applying means for preventing adhesion step further includes applying means for preventing adhesion onto the rotatable wheel prior to said deforming step.

10. The method of claim 7 wherein the means for preventing adhesion further includes a liquid and said applying means for preventing adhesion step further includes applying the liquid onto the rotatable wheel prior to said deforming step.

11. The method of claim 1 wherein the means for preventing adhesion further includes a liquid and said applying means for preventing adhesion step further includes applying the liquid onto the traffic stripe material prior to said deforming step.

12. The method of claim 1 wherein said first particulate reflective material applying step comprises dispersing the reflective material over the traffic stripe by applying the reflective material with a spray gun.

13. The method of claim 1 wherein said applying a first particulate reflective material step applies a first amount of the first reflective material to the traffic stripe and said applying a second particulate reflective material applies a second amount of the second reflective material to the traffic stripe, the first amount of the first reflective material being less than the second amount of the second reflective material.

14. The method of claim 1 wherein said applying means for preventing adhesion step further includes applying means for preventing adhesion onto the deformation means prior to said deforming step.

15. The method of claim 1 wherein the means for preventing adhesion further includes a liquid and said applying means for preventing adhesion step further includes applying the liquid onto the deformation means prior to said deforming step.

* * * * *